US010921726B2

(12) United States Patent
Murai

(10) Patent No.: US 10,921,726 B2
(45) Date of Patent: Feb. 16, 2021

(54) IMAGE FORMING APPARATUS AND IMAGE FORMING METHOD USING OVERLAPPING TONER IMAGES

(71) Applicant: Oki Data Corporation, Tokyo (JP)

(72) Inventor: Satoru Murai, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/532,929

(22) Filed: Aug. 6, 2019

(65) Prior Publication Data

US 2020/0073271 A1 Mar. 5, 2020

(30) Foreign Application Priority Data

Aug. 31, 2018 (JP) ..... 2018-162777

(51) Int. Cl.
*G03G 15/00* (2006.01)
*G03G 15/01* (2006.01)
*G03G 9/08* (2006.01)

(52) U.S. Cl.
CPC ..... *G03G 15/0178* (2013.01); *G03G 15/6585* (2013.01); *G03G 9/0821* (2013.01); *G03G 2215/00476* (2013.01)

(58) Field of Classification Search
CPC ..... G03G 15/0178; G03G 15/6585; G03G 2215/00476; G03G 2215/00493; G03G 2215/00497; G03G 2215/00502; G03G 9/0821
See application file for complete search history.

(56) References Cited

U.S. PATENT DOCUMENTS 5,496,791 A * 3/1996 Ohno ..... B41M 5/41 428/206
2004/0057748 A1* 3/2004 Egusa ..... G03G 15/6591 399/107
2015/0072280 A1* 3/2015 Hiraide ..... G03G 15/6585 430/105
2015/0093697 A1* 4/2015 Hashimoto ..... G03G 9/0804 430/105
2017/0157974 A1* 6/2017 Kabalnov ..... G03G 5/14795
2018/0314179 A1* 11/2018 Cohen ..... G03G 9/132
2019/0025734 A1* 1/2019 Ron ..... G03G 9/08726

FOREIGN PATENT DOCUMENTS

JP 2010-152209 A 7/2010

* cited by examiner

*Primary Examiner* — Walter L Lindsay, Jr.
*Assistant Examiner* — Laura Roth
(74) *Attorney, Agent, or Firm* — Panitch Schwarze Belisario & Nadel LLP

(57) ABSTRACT

An image forming apparatus includes a first toner image forming unit, a second toner image forming unit, and a transfer section. The first toner image forming unit forms a first toner image with use of a first toner. The first toner has a complex viscosity that falls within a range from 625 Pascal-seconds to 3860 Pascal-seconds, both inclusive, at a temperature of 100 degrees centigrade. The second toner image forming unit forms a second toner image with use of a second toner. The transfer section transfers the first toner image onto a print medium, and transfers the second toner image onto the print medium in a region that overlaps a portion or all of a region where the first toner image has been transferred. The print medium includes a polymer compound.

13 Claims, 4 Drawing Sheets

IMAGE FORMING APPARATUS AND IMAGE FORMING METHOD USING OVERLAPPING TONER IMAGES

CROSS REFERENCE TO RELATED APPLICATIONS

The present application claims priority from Japanese Patent Application No. 2018-162777 filed on Aug. 31, 2018, the entire contents of which are hereby incorporated by reference.

BACKGROUND

The technology relates to an image forming apparatus that forms an image with the use of a toner and to an image forming method.

An electrophotographic image forming apparatus is in widespread use. One reason for this is that the electrophotographic image forming apparatus allows a high-quality image to be obtained in a short time, as compared with an image forming apparatus of other method such as an inkjet method.

An electrophotographic image forming apparatus forms an image on a print medium with the use of a toner. Hereinafter, the electrophotographic image forming apparatus will be simply referred to as an "image forming apparatus." In this case, a toner attached to an electrostatic latent image is transferred onto a print medium, and the toner is thereafter fixed to the print medium. Thereby, an image is formed.

A configuration of an image forming apparatus influences quality of an image. For this reason, various proposals have been made concerning a configuration of an image forming apparatus. Specifically, in order to obtain an image having desired glossiness also in a case where print media have different surface roughness, a transparent developer image is formed on a print medium, and thereafter, a colored developer image is formed on the transparent developer image. For example, reference can be made to Japanese Unexamined Patent Application Publication No. 2010-152209.

SUMMARY

Although various proposals have been made concerning a configuration of an image forming apparatus, quality of an image is not yet sufficient, still leaving room for improvement.

It is desirable to provide an image forming apparatus and an image forming method that make it possible to form an image with high quality.

According to one embodiment of the technology, there is provided an image forming apparatus that includes a first toner image forming unit, a second toner image forming unit, and a transfer section. The first toner image forming unit forms a first toner image with use of a first toner. The first toner has a complex viscosity that falls within a range from 625 Pascal-seconds to 3860 Pascal-seconds, both inclusive, at a temperature of 100 degrees centigrade. The second toner image forming unit forms a second toner image with use of a second toner. The transfer section transfers the first toner image onto a print medium, and transfers the second toner image onto the print medium in a region that overlaps a portion or all of a region where the first toner image has been transferred. The print medium includes a polymer compound.

According to one embodiment of the technology, there is provided an image forming method including: forming a first toner image with use of a first toner, the first toner having a complex viscosity that falls within a range from 625 Pascal-seconds to 3860 Pascal-seconds, both inclusive, at a temperature of 100 degrees centigrade; forming a second toner image with use of a second toner; transferring the first toner image onto a print medium, the print medium including a polymer compound; and transferring, after the transferring of the first toner image onto the print medium, the second toner image onto the print medium in a region that overlaps a portion or all of a region where the first toner image has been transferred.

DETAILED DESCRIPTION

Figure 1:
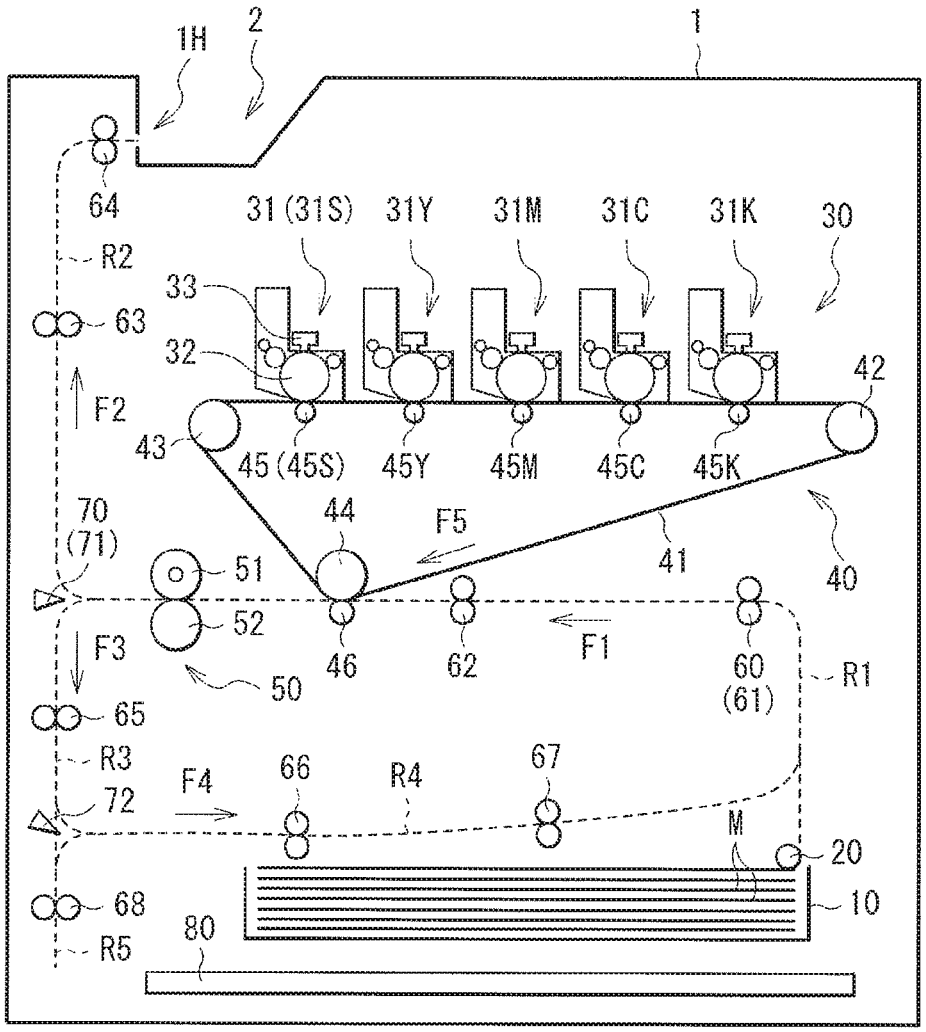
FIG. 1 is a plan view of an example of a configuration of an image forming apparatus according to one embodiment of the technology.

Hereinafter, an example embodiment of the technology will be described in detail with reference to the drawings.

Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The technology will be described in the following order.

1. Image Forming Apparatus and Image Forming Method
   1-1. General Configuration
   1-2. Configuration of Toner
   1-3. Operation
   1-4. Example Workings and Example Effects
2. Modification Examples

1. IMAGE FORMING APPARATUS AND IMAGE FORMING METHOD

First, an image forming apparatus according to an example embodiment of the technology is described. An image forming method according to an example embodiment of the technology may be implemented through operation of the image forming apparatus. A description of the image forming method is therefore given alongside the following description.

Figure 5:
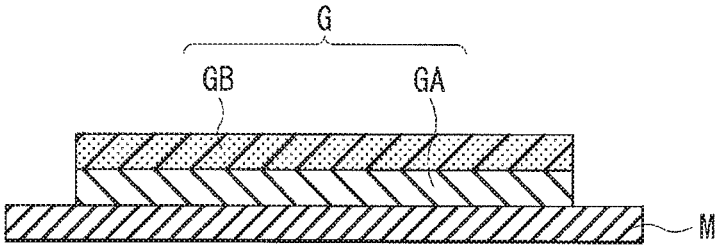
FIG. 5 is a cross-sectional view of an example of a configuration of a print medium on which a color image is formed.

As will be described later, the image forming apparatus described in this example may form an image G, including a base image GA and a color image GB, on a print medium M with two types of toners, i.e., a base toner and a color toner, as illustrated in FIGS. 1 and 5. The image forming apparatus described in this example may be a so-called electrophotographic full-color printer. The image forming apparatus may employ, for example, an intermediate transfer method in which an intermediate transfer medium, e.g., a transfer belt 41, is used to form the image G on the print medium M.

The print medium M may include one or more types of polymer compounds. Therefore, the print medium M may be a so-called resin print medium. There is no particular limitation on the type of the polymer compound. Non-limiting examples of the polymer compound may include polyethylene terephthalate (PET) and polyvinyl chloride (PVC). One reason for this is that the material of the print medium M, i.e., the type of the polymer compound, may be made appropriate in relation to a configuration and a physical property of the base toner, as will be described later. This improves a fixing performance of the image G to the print medium M, which makes it more difficult for the image G to peel off of the print medium M.

There is no particular limitation on smoothness of a surface of the print medium M. In one example embodiment, the surface of the print medium M may have a Bekk smoothness of no less than 100000 seconds. One reason for this is that this configuration improves the fixing performance of the image G to the print medium M while ensuring the smoothness of the surface of the print medium M, as will be described later. In other words, one reason for the above is that the above-described configuration makes it easier for the image G to be fixed to the print medium M also when the smoothness of the surface of the print medium M is high, making it more difficult for the image G to peel off of the print medium M.

Figure 2:
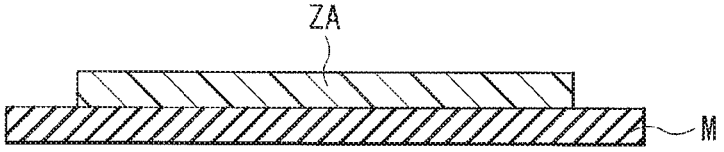
FIG. 2 is a cross-sectional view of an example of a configuration of a print medium onto which a base toner image is transferred.
Figure 4:
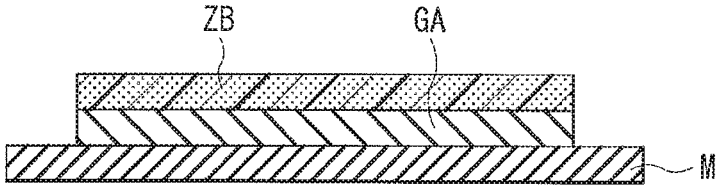
FIG. 4 is a cross-sectional view of an example of a configuration of a print medium onto which a color toner image is transferred.

The surface of the print medium M described in this example may be a surface, of the print medium M, on which the image G, including the base image GA and the color image GB, is to be formed. In other words, the stated surface may be a surface, of the print medium M, onto which each of a base toner image ZA and a color toner image ZB is to be transferred, as illustrated in FIGS. 2 and 4. The base toner image ZA and the color toner image ZB will be described later. A method and a condition for measuring the Bekk smoothness are in compliant with Japanese industrial standards (JIS) P 8119:1998.

[1-1. General Configuration]

FIG. 1 illustrates a planar configuration of the image forming apparatus. In forming an image with the image forming apparatus, the print medium M may be conveyed along conveyance routes R1 to R4 indicated by dashed lines, and the print medium M may be conveyed in conveying directions F1 to F4.

As illustrated in FIG. 1, the image forming apparatus may include, for example but not limited to, a tray 10, a feeding roller 20, a developing section 30, a transfer section 40, a fixing section 50, a conveying roller 60, a conveyance path switching guide 70, and a control board 80. The above-described components may be housed in a housing 1. The housing 1 may be provided with a stacker 2 to which the print medium M having the image G formed thereon is to be discharged. The print medium M having the image G formed thereon may be discharged to the stacker 2 through a discharge opening 1H provided in the housing 1. The transfer section 40 may correspond to a "transfer section" in one specific but non-limiting embodiment of the technology.

The image forming apparatus described in this example may control, for example, a conveyance state of the print medium M with the use of the conveyance path switching guide 70. This control may allow the image forming apparatus to form the image G not only on one side of the print medium M but also on both sides of the print medium M. The stated control may also allow the image forming apparatus to form the image G on one side of the print medium M twice or more.

Hereinafter, a surface, of the print medium M, on which the image G is formed in a case where the image forming apparatus forms the image G on only one side of the print medium M may be referred to as a "front surface" of the print medium M. In contrast, a surface, of the print medium M, that is opposite to the front surface may be referred to as a "back surface" of the print medium M.

A series of rollers described below, that is, any component that includes the expression "roller" in its name may be a cylindrical member extending in a direction intersecting the paper plane of FIG. 1 and may be rotatable about an axis of rotation extending in the direction intersecting the paper plane of FIG. 1.

[Tray and Feeding Roller]

The tray 10 may, for example, contain a plurality of print media M. The tray 10 may be mountable to or removable from the housing 1. The feeding roller 20 may, for example, take out the print medium M from the tray 10 and feed out the print medium M into the conveyance route R1.

[Developing Section]

The developing section 30 may perform a developing process with the use of a toner. In a specific but non-limiting example, the developing section 30 may, for example, form an electrostatic latent image and cause the toner to be attached to the electrostatic latent image with the use of the Coulomb force.

The developing section 30 may include, for example but not limited to, a developing process unit 31 that performs the developing process. The developing process unit 31 may include, for example but not limited to, a photosensitive drum 32, and an electrostatic latent image may be formed on the photosensitive drum 32. The developing process unit 31 may be provided, for example but not limited to, with a light source 33 directed to forming the electrostatic latent image on a surface of the photosensitive drum 32. The light source 33 may include, for example but not limited to, a light-emitting diode (LED). The developing process unit 31 may further include, for example but not limited to, a charging roller, a developing roller, a feeding roller, and a developing blade.

In this example, the developing section 30 may include, for example but not limited to, five developing process units 31, i.e., developing process units 31S, 31Y, 31M, 31C, and 31K. The developing process units 31S, 31Y, 31M, 31C, and 31K may be disposed in this order from upstream side toward downstream side in a moving direction F5 of the transfer belt 41, for example. The transfer belt 41 will be described later. The developing process unit 31S may correspond to a "first toner image forming unit" in one specific but non-limiting embodiment of the technology. The developing process units 31Y, 31M, 31C, and 31K may each correspond to a "second toner image forming unit" in one specific but non-limiting embodiment of the technology.

The developing process units 31S, 31Y, 31M, 31C, and 31K may have similar configurations except that the types and the colors of toners used in the developing process differ from one another among the developing process units 31S, 31Y, 31M, 31C, and 31K. As described above, two types of toners, i.e., the base toner and the color toner, may be used in this example.

In a specific but non-limiting example, the developing process unit 31S may be provided, for example, with a base toner. The developing process unit 31Y may be provided, for example, with a color toner, e.g., a yellow toner. The developing process unit 31M may be provided, for example, with another color toner, e.g., a magenta toner. The developing process unit 31C may be provided, for example, with another color toner, e.g., a cyan toner. The developing process unit 31K may be provided, for example, with another color toner, e.g., a black toner. The base toner may correspond to a "first toner" in one specific but non-limiting embodiment of the technology. The color toner may correspond to a "second toner" in one specific but non-limiting embodiment of the technology.

The color toners, i.e., the yellow toner, the magenta toner, the cyan toner, and the black toner, may be used to form a full-color image. For example, the color toners may be used to form the color image GB, as illustrated in FIG. 5. The color image GB will be described later. The base toner, in contrast, may be used to ensure the quality of the image G. For example, the base toner may be used to form the base image GA, as illustrated in FIG. 5. The base image GA will be described later. The quality of the image G described above may include, for example but not limited to, the fixing performance of the image G to the print medium M and the image quality of the image G, as will be described later. A detailed configuration of each of the base toner and the color toners, i.e., the yellow toner, the magenta toner, the cyan toner, and the black toner, will be described later. Hereinafter, the base toner and the color toners may be collectively referred to as "toner."

For example, as will be described later, the developing process unit 31S may form the base toner image ZA with the use of the base toner in order to form the base image GA, as illustrated in FIG. 2. As will be described later, each of the developing process units 31Y, 31M, 31C, and 31K may form the color toner image ZB with the use of the corresponding color toner, i.e., corresponding one of the yellow toner, the magenta toner, the cyan toner, and the black toner, in order to form the color image GB, as illustrated in FIG. 4. The base toner image ZA may correspond to a "first toner image" in one specific but non-limiting embodiment of the technology. The color toner image ZB may correspond to a "second toner image" in one specific but non-limiting embodiment of the technology.

[Transfer Section]

The transfer section 40 may perform a transfer process of the toner that has been subjected to the developing process by the developing section 30. In a specific but non-limiting example, the transfer section 40 may, for example, transfer, onto the transfer belt 41, the toner that has been attached to an electrostatic latent image, and transfer the toner from the transfer belt 41 onto the print medium M.

The transfer section 40 may include, for example but not limited to, the transfer belt 41, a drive roller 42, an idler roller 43, a backup roller 44, a primary transfer roller 45, and a secondary transfer roller 46.

The transfer belt 41 may be an endless belt, for example. The transfer belt 41 may be stretched upon the drive roller 42, the idler roller 43, and the backup roller 44 and may be movable in the moving direction F5 in response to rotation of the drive roller 42, for example. The drive roller 42 may be rotatable, for example, by a driving source such as a motor. The idler roller 43 and the backup roller 44 may each be rotatable in response to the rotation of the drive roller 42, for example.

The primary transfer roller 45 may be in contact with the photosensitive drum 32 with the transfer belt 41 interposed therebetween. The primary transfer roller 45 may transfer, onto the transfer belt 41, the toner attached to the electrostatic latent image. In other words, the primary transfer roller 45 may perform primary transfer. In this example, the transfer section 40 may include, for example, five primary transfer rollers 45, i.e., primary transfer rollers 45S, 45Y, 45M, 45C, and 45K, corresponding to the respective five developing process units 31, i.e., the developing process units 31S, 31Y, 31M, 31C, and 31K.

The secondary transfer roller 46 may oppose the backup roller 44 with the conveyance route R1 interposed therebetween. The secondary transfer roller 46 may be in contact with the backup roller 44 with the transfer belt 41 interposed therebetween. The secondary transfer roller 46 may transfer, onto the transfer belt 41, the toner transferred onto the print medium M. In other words, the secondary transfer roller 46 may perform secondary transfer.

Figure 3:
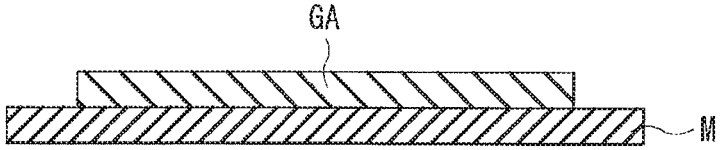
FIG. 3 is a cross-sectional view of an example of a configuration of a print medium on which a base image is formed.

For example, as will be described later, the transfer section 40 may transfer the base toner image ZA and the color toner image ZB in this order onto the transfer belt 41. The transfer section 40 may further transfer the base toner image ZA and the color toner image ZB in this order from the transfer belt 41 onto the print medium M, as illustrated in FIGS. 2 to 4.

In a more specific but non-limiting example, the transfer section 40 may transfer the base toner image ZA onto the print medium M. Thereafter, the transfer section 40 may transfer the color toner image ZB onto the print medium M in a region that overlaps a portion or a whole of a region where the base toner image ZA has been transferred. Hereinafter, the region where the base toner image ZA is transferred may be also referred to as a "transfer region of the base toner image ZA", and a region where the color toner image ZB is transferred may be also referred to as a "transfer region of the color toner image ZB." In other words, the transfer region of the color toner image ZB may correspond to a portion of the transfer region of the base toner image ZA or may correspond to the whole of the transfer region of the base toner image ZA. The transfer region of the color toner image ZB may coincide with the transfer region of the base toner age ZA or may be partially off the transfer region of the base toner image ZA. One reason for this is that, the presence of the base toner image ZA between a portion or the whole of the color toner image ZB and the print medium M improves the fixing performance of the image G to the print medium M, as compared with a case where the base toner image ZA is absent between the color toner image ZB and the print medium M, as will be described later.

In one example embodiment, when the transfer section 40 transfers the color toner image ZB onto the print medium M, the transfer section 40 may transfer the color toner image ZB onto the print medium M within the region where the base toner image ZA has been transferred. One reason for this is that, since this configuration provides the base toner image ZA between the whole of the color toner image ZB and the print medium M, the fixing performance of the image G to the print medium M notably improves.

[Fixing Section]

The fixing section 50 may perform a fixing process of the toner transferred onto the print medium M by the transfer section 40. In a specific but non-limiting example, the fixing section 50 may fix the toner to the print medium M, for example, by applying pressure to the print medium M onto which the toner has been transferred while heating the print medium M.

The fixing section 50 may include, for example, a heating roller 51 and a pressure-applying roller 52. The heating roller 51 and the pressure-applying roller 52 may oppose each other with the conveyance route R1 interposed therebetween. The heating roller 51 may include, for example, a built-in heat source such as a halogen lamp. The heating roller 51 may heat the print medium M onto which the toner has been transferred. The pressure-applying roller 52 may be in contact with the heating roller 51. The pressure-applying roller 52 may apply pressure to the print medium M onto which the toner has been transferred.

For example, as will be described later, the fixing section 50 may perform a fixing process of the base toner image ZA that has been transferred onto the print medium M. Thereafter, the fixing section 50 may perform a fixing process of the color toner image ZB that has been transferred onto the print medium M. The fixing process of the base toner image ZA may fix the base toner image ZA, i.e., the base toner, to the print medium M, thereby forming the base image GA on the print medium M, as illustrated in FIGS. 2 and 3. The fixing process of the color toner image ZB may fix the color toner image ZB, i.e., the color toner, to the print medium M, thereby forming the color image GB on the print medium M, as illustrated in FIGS. 4 and 5.

In other words, the transfer section 40 may transfer the base toner image ZA and the color toner image ZB in this order onto the print medium M, as described above. With this operation, the fixing section 50 may, for example, form the base image GA on the print medium M by performing the fixing process of the base toner image ZA. Thereafter, the fixing section 50 may, for example, form the color image GB on the print medium M by performing the fixing process of the color toner image ZB. One reason for this is that performing the fixing process of the base toner image ZA and the fixing process of the color toner image ZB in separate steps makes it easier for the base image GA to be fixed to the print medium M and also makes it easier for the color image GB to be fixed to the base image GA, as compared with a case where the fixing process of the base toner image ZA and the fixing process of the color toner image ZB are performed in a single step. Accordingly, as will be described later, the print medium M may be overlaid with the base image GA and the color image GB in this order, and the image G including the base image GA and the color image GB may be formed thereby, as illustrated in FIGS. 2 to 5.

[Conveying Rolled]

The conveying roller 60 may include, for example but not limited to, pairs of rollers. Each pair of rollers may oppose each other with corresponding one of the conveyance routes R1 to R5 interposed therebetween. The conveying roller 60 may convey the print medium M along any of the conveyance routes R1 to R5. In this example, the image forming apparatus may include, for example but not limited to, eight conveying rollers 60, i.e., conveying rollers 61 to 68.

In a case where an image is to be formed only on one side, i.e., the front surface, of the print medium M, the print medium M may be conveyed by the conveying rollers 61 to 64 along the conveyance routes R1 and R2, for example. In a case where an image is to be formed on each side, i.e., each of the front surface and the back surface, of the print medium M, the print medium M may be conveyed by the conveying rollers 61 to 68 along the conveyance routes R1 to R5, for example. In a case where an image is to be formed on one side, i.e., the front surface, of the print medium M twice or more, the print medium M may be conveyed by the conveying rollers 61 to 67 along the conveyance routes R1 to R4, for example.

[Conveyance Path Switching Guide]

The conveyance path switching guide 70 may switch a conveyance state of the print medium M in accordance with a mode of an image to be formed on the print medium M. The mode of the image may include, for example but not limited to, a mode in which an image is formed only on one side of the print medium M, a mode in which an image is formed on each side of the print medium M, and a mode in which an image is formed on one side of the print medium M twice or more.

In this example, the image forming apparatus may include, for example, two conveyance path switching guides 70, i.e., conveyance path switching guides 71 and 72. The conveyance path switching guide 71 may be disposed, for example, at a junction of the conveyance routes R2 and R3. The conveyance path switching guide 72 may be disposed, for example, at a junction of the conveyance routes R3 to R5.

[Control Board]

The control board 80 may control overall operation of the image forming apparatus. The control board 80 may be a circuit board provided with, for example but not limited to, a control circuit, a memory, an input-output port, and a timer. The control circuit may include, for example but not limited to, a central processing unit (CPU).

[1-2. Configuration of Toner]

The toner described in this example may be a negatively-charged toner of a single component development system, for example. In other words, the toner may have a negatively-charging polarity, for example. In the single component development system, the toner itself may be provided with an appropriate amount of electric charge without the use of a carrier, i.e., a magnetic particle, directed to providing an electric charge to the toner.

There is no particular limitation on the method of manufacturing the toner. The method of manufacturing the toner may include, for example, one or more of methods such as a pulverization method or a polymerization method. Non-limiting examples of the polymerization method may include an emulsion polymerization aggregation method and a solution suspension method.

[Configuration of Base Toner]

The base toner may include a binder resin. The binder resin may include, for example but not limited to, one or more types of polymer compounds.

There is no particular limitation on the type of the polymer compound. Non-limiting examples of the polymer compound may include a polyester-based resin. The polyester-based resin may be a collective term including polyesters and derivatives thereof. There is no particular limitation on the crystalline state of the polyester-based resin. The polyester-based resin may be crystalline or amorphous, or may be in a state that includes both a crystalline portion and an amorphous portion. One reason for the above is that, since the polyester-based resin has high affinity for the print medium M, which is a so-called resin print medium, it is easier for the base toner including the polyester-based resin to be fixed to the print medium M. This makes it easier for the base image GA to be fixed to the print medium M, making it more difficult for the image G to peel off of the print medium M.

There is no particular limitation on the color of the base toner. The base toner may include a colorant or may not include any colorant.

In a case where the base toner includes no colorant, the base toner may be colorless, i.e., transparent. The colorless base toner may be a so-called clear toner. In this case, the base toner image ZA may be colorless, and therefore, the hue of the base toner image ZA may have little influence on the hue of the color toner image ZB.

In a case where the base toner includes a colorant, there is no particular limitation on the color of the base toner. The color of the base toner may be, for example, any of colors such as yellow, magenta, cyan, black, white, or a mixture of two or more thereof. In this case, the base toner may include, for example, a colorant of a color corresponding to the color of the base toner. The colorant may include, for example but not limited to, one or more pigments. In a specific but non-limiting example, a white base toner may include, for example, a pigment such as titanium oxide, as a colorant.

In a case where the base toner includes a colorant, in one example embodiment, the base toner may have a color that makes it more difficult for the hue of the base toner image ZA to influence the hue of the color toner image ZB. Accordingly, in one example embodiment, the color of the base toner may be white. However, as long as the base toner has a color that makes it more difficult for the hue of the base toner image ZA to influence the hue of the color toner image ZB, the color of the base toner is not limited to white and may be a light color such as light gray.

In one example embodiment, the base toner may be colorless, i.e., transparent or white. In another example embodiment, the base toner may be colorless. In yet another example embodiment, the base toner may be a colorless toner, i.e., a clear toner, that includes no colorant. One reason for this is that the hue of the base toner image ZA has little influence on the hue of the color toner image ZB in such cases, as described above.

The base toner may further include one or more types of other materials such as an additive. There is no particular limitation on the type of the other materials. Non-limiting examples of the other materials may include an external additive, a release agent, an electric charge control agent, a fluorescent brightener, an electric conductivity modifier, a reinforcement filler, an antioxidant, an antistaling agent, a flow improver, and a cleanability improver.

The fluorescent brightener may mainly increase the degree of whiteness of the base toner. In a case where the base toner is unintentionally colored in a color other than white because the binder resin is colored in a color other than white, e.g., slightly colored in yellow, in one example embodiment, the base toner may include a fluorescent brightener. One reason for this is that the degree of whiteness of the base toner, i.e., the binder resin, increases, and the color of the base toner becomes closer to white. In a case where the base toner includes a fluorescent brightener, the base toner may exhibit blue glow upon receiving ultraviolet light. This may allow the fluorescent brightener to be regarded as a type of colorant. The fluorescent brightener described in this example may, however, merely be an additive, i.e., a component, used to increase the degree of whiteness of the base toner. Accordingly, the fluorescent brightener may be a component different from a colorant, e.g., a pigment or a dye directed to coloring in a color such as yellow other than white.

[Configuration of Color Toners: Yellow Toner, Magenta Toner, Cyan Toner, and Black Toner]

The yellow toner, the magenta toner, the cyan toner, and the black toner may include colorants in colors corresponding to their respective colors. The colorants may be a yellow colorant, a magenta colorant, a cyan colorant, and a black colorant.

In a specific but non-limiting example, the yellow toner may have a configuration similar to that of the base toner except that the yellow toner includes, for example, one or more types of yellow colorants. The yellow colorant may be, for example, a pigment such as Pigment Yellow 74.

The magenta toner may have a configuration similar to that of the yellow toner except that the magenta toner includes, for example, a magenta colorant in place of the yellow colorant. The magenta colorant may be, for example, a pigment such as quinacridone.

The cyan toner may have a configuration similar to that of the yellow toner except that the cyan toner includes, for example, a cyan colorant in place of the yellow colorant. The cyan colorant may be, for example, a pigment such as Phthalocyanine Blue.

The black toner may have a configuration similar to that of the yellow toner except that the black toner includes, for example, a black colorant in place of the yellow colorant. The black colorant may be, for example, a pigment such as carbon black.

[Physical Property of Base Toner]

The base toner may have a physical property that is made appropriate in order to improve the fixing performance of the image G to the print medium M while ensuring the image quality of the image G.

[Complex Viscosity]

In one example embodiment, the base toner has a complex viscosity that falls within a range from 625 Pa·s to 3860 Pa·s, both inclusive, at a temperature of 100° C. One reason for this is that, in this case, the physical property of the base toner, i.e., the complex viscosity η at the temperature of 100° C., is made appropriate relative to the material of the print medium M, i.e., the polymer compound, as described above. This improves the fixing performance of the image G to the print medium M while ensuring the image quality of the image G. Details of the reason why the above-described advantage is obtainable will be described later. Hereinafter, the complex viscosity η at the temperature of 100° C. may be also referred to as a "complex viscosity η (100° C.)."

The aforementioned "complex viscosity η (100° C.)" of the base toner may be obtained by analyzing the base toner with the use of a viscoelasticity measuring apparatus. In this case, for example, Discovery HR-2 available from TA Instruments located in Delaware, United States may be used as the viscoelasticity measuring apparatus. As for the analysis conditions, a measured temperature range may be from 50° C. to 230° C., both inclusive; a temperature increase rate may be 5° C./min, and a frequency may be 1 Hz.

In one example embodiment, the complex viscosity η (100° C.) of the base toner may be made appropriate in relation to a complex viscosity η (100° C.) of the color toner. In one example embodiment, a viscosity difference Δη (Pa·s), a difference between the complex viscosity η (100° C.) of the base toner and the complex viscosity η (100° C.) of the color toner may fall within a range from 8745 Pa·s to 11980 Pa·s, both inclusive. One reason for this is that the viscosity difference Δη within the above-described range ensures the fixing performance of the color image GB to the base image GA. The above-described viscosity difference Δη may be calculated by a calculation expression [the complex viscosity η (100° C.) of the color toner]−[the complex viscosity η (100° C.) of the base toned]. The complex viscosity η (100° C.) of the color toner may be obtained by a procedure similar to that of obtaining the complex viscosity η (100° C.) of the base toner described above.

In one example embodiment, the complex viscosity η (100° C.) of the base toner may fall within a range from 625 Pa·s to 2132 Pa·s, both inclusive, and the viscosity difference Δη may fall within a range from 10473 Pa·s to 11980 Pa·s, both inclusive. One reason for this is that the the complex viscosity η (100° C.) of the base toner within the above-described range and the viscosity difference Δη within the above-described range further improve the fixing performance of the image G to the print medium M.

[Weight-Average Molecular Weight Mw]

There is no particular limitation on a weight-average molecular weight Mw of the binder resin, i.e., the polymer compound, included in the base toner. In one example embodiment, the weight-average molecular weight Mw of the binder resin included in the base toner may fall within a range from 5242 to 18039, both inclusive. One reason for this is that the weight-average molecular weight Mw within the above-described range of the binder resin may be appropriate relative to the material, i.e., the polymer compound, of the print medium M, which sufficiently improves the image quality of the image G while sufficiently improving the fixing performance of the image G to the print medium M. Details of the reason why the above-described advantage is obtainable will be described later.

In one example embodiment, the physical property of the base toner, i.e., the weight-average molecular weight Mw of the binder resin included in the base toner, may be made appropriate relative to the physical property of the color toner, i.e., the weight-average molecular weight Mw of the binder resin included in the color toner. In one example embodiment, a molecular weight difference ΔMw, i.e., a difference between the weight-average molecular weight Mw of the binder resin included in the base toner and the weight-average molecular weight Mw of the binder resin included in the color toner may fall within a range from 90553 to 103350, both inclusive. One reason for this is that the molecular weight difference ΔMw within the above-described range ensures the fixing performance of the color image GB to the base image GA. The above-described molecular weight difference ΔMw may be calculated by a calculation expression [the weight-average molecular weight Mw of the binder resin included in the color toner]−[the weight-average molecular weight Mw of the binder resin included in the base toner].

In one example embodiment, the weight-average molecular weight Mw of the binder resin included in the base toner may fall within a range from 5242 to 12433, both inclusive, and the molecular weight difference ΔMw may fall within a range from 96159 to 103350, both inclusive. One reason for this is that the weight-average molecular weight Mw of the binder resin included in the base toner within the above-described range and the molecular weight difference ΔMw within the above-described range further improve the fixing performance of the image G to the print medium M.

In order to identify the weight-average molecular weight Mw, the base toner may be analyzed by high-performance liquid chromatography (HPLC). Thereby, molecular weight distribution of the binder resin, i.e., the polymer compound, may be measured, and the weight-average molecular weight Mw may be obtained on the basis of a result of the measurement of the molecular weight distribution.

In a case where a sample for an analysis is prepared, for example, the base toner may be put in an organic solvent such as tetrahydrofuran, and this organic solvent may be stirred to allow a soluble component, i.e., the binder resin, in the base toner to dissolve. In a case where an analysis is conducted, for example, high-performance liquid chromatograph Prominence system LC-20AD available from Shimadzu Corporation located in Kyoto, Japan may be used as an analyzing apparatus. As for the analyzing conditions, the oven temperature may be set to 40° C., and the pump flow rate may be set to 10000 ml/min.

The weight-average molecular weight Mw of the binder resin included in the color toner may be obtained by a procedure similar to that of obtaining weight-average molecular weight Mw of the binder resin included in the base toner described above.

[Attached Amount of Toner]

There is no particular limitation on the amount of the base toner transferred onto the print medium M. Similarly, there is no particular limitation on the amount of the color toner transferred onto the print medium M.

In one example embodiment, the amount of the transferred base toner and the amount of the transferred color toner may satisfy the two conditions described below.

A first condition may be that a weight X ($mg/cm^2$), per unit area, of the base toner image ZA transferred onto the print medium M is from 0.20 $mg/cm^2$ to 0.40 $mg/cm^2$, both inclusive. The weight X may be a weight of the base toner on the print medium M, that is, the amount of the base toner attached to the print medium M.

A second condition may be that a sum, i.e., a total weight, Y of the weight X ($mg/cm^2$), per unit area, of the base toner image ZA transferred onto the print medium M and a weight ($mg/cm^2$), per unit area, of the color toner image ZB transferred onto the print medium M is from (X+0.30) $mg/cm^2$ to (X+0.45) $mg/cm^2$, both inclusive. The total weight Y may be a total weight of the base toner and the color toner on the print medium M, that is, the total amount of the base toner and the color toner that are attached to the print medium M.

One reason for the above is that the fixing performance of the image G, including the base image GA and the color image GB, to the print medium M further improves while the density of the color image GB is ensured. Details of the reason why the advantage described in this example is obtainable will be described later.

In one example embodiment, the weight X described in this example may be the weight of the base toner image ZA per unit area in a region in which the transfer region of the base toner image ZA and the transfer region of the color toner image ZB overlap each other. The total weight Y may be the sum of the weight X of the base toner image ZA per unit area and the weight of the color toner image ZB per unit area in the region in which the transfer region of the base toner image ZA and the transfer region of the color toner image ZB overlap each other. One reason for this is that, in a case where the base toner image ZA is present between the whole of the color toner image ZB and the print medium M, the weight X and the total weight Y are each made appropriate, and thereby, the fixing performance of the image G to the print medium M notably improves.

[1-3. Operation]

FIG. 2 illustrates a cross-sectional configuration of the print medium M onto which the base toner image ZA is transferred. FIG. 3 illustrates a cross-sectional configuration of the print medium M on which the base image GA is formed. FIG. 4 illustrates a cross-sectional configuration of the print medium M onto which the color toner image ZB is transferred. FIG. 5 illustrates a cross-sectional configuration of the print medium M on which the color image GB is formed. In FIGS. 4 and 5, respectively, the color toner image ZB and the color image GB that each include the color toner are indicated with hatching.

Detailed descriptions have already been given on: the configuration, of the print medium M, including the material and the Bekk smoothness; the configuration, of the toners, i.e., the base toner and the color toners, including the weight-average molecular weight of the binder resin; and the amount of the attached toners including the weight X and the total weight Y. Descriptions thereof will be therefore omitted below where appropriate.

In a case where the image G is to be formed on the print medium M, upon image data having been transmitted to the image forming apparatus from an external apparatus, for example, the print medium M may be fed out into the conveyance route R1 from the tray 10 by the feeding roller 20. The external apparatus may be, for example, a personal computer. Thereafter, the image forming apparatus may perform, for example, a developing process, a primary transfer process, a secondary transfer process, and a fixing process in this order, as described below. Operation related to the series of processes described in this example may be controlled, for example, by the control board 80.

Described below is, an example case where the primary transfer process, the secondary transfer process, and the fixing process are each performed twice in order to form the base image GA and thereafter the color image GB in the process of forming the image G.

[Developing Process]

First, the developing process may be performed in the developing section 30. In a specific but non-limiting example, in the developing process unit 31S, an electrostatic latent image may be formed on the surface of the photosensitive drum 32, and the base toner may be attached to the electrostatic latent image. Further, in each of the developing process units 31Y, 31M, 31C, and 31K, an electrostatic latent image may be formed on the surface of the photosensitive drum 32, and the color toner, i.e., corresponding one of the yellow toner, the magenta toner, the cyan toner, and the black toner, may be attached to the electrostatic latent image.

Whether the developing process is actually performed in each of the developing process units 31Y, 31M, 31C, and 31K may be determined on the basis of the color or a combination of colors necessary for forming the color toner image ZB. The foregoing description may similarly apply in determining whether the primary transfer process is actually performed in each of the primary transfer rollers 45Y, 45M, 45C, and 45K. The primary transfer process will be described later.

[Primary Transfer Process (First Time)]

Thereafter, in the transfer section 40, upon the transfer belt 41 moving in the moving direction F5, the base toner may undergo primary transfer onto the transfer belt 41 from the photosensitive drum 32, i.e., from the electrostatic latent image, as the primary transfer roller 45S is in contact with the photosensitive drum 32 with the transfer belt 41 interposed therebetween. Thereby, the base toner image ZA may be formed on the transfer belt 41.

[Secondary Transfer Process (First Time)]

Thereafter, in the transfer section 40, upon the transfer belt 41 moving further in the moving direction F5, the base toner image ZA may undergo secondary transfer onto the print medium M from the transfer belt 41, as illustrated in FIG. 2, as the secondary transfer roller 46 is in contact with the backup roller 44 with the transfer belt 41 interposed therebetween.

There is no particular limitation on the printing density of the base toner image ZA. In one example embodiment, the printing density may be no lower than 50%. In another example embodiment, the printing density may be 100%. One reason for this is that the forming amount of the base image GA is ensured, and the use of this base image GA allows the image G to be sufficiently fixed to the print medium M.

[Fixing Process (First Time)]

Thereafter, in the fixing section 50, the base toner image ZA may be heated by the heating roller 51 while having applied with pressure by the pressure-applying roller 52. Thereby, the base toner image ZA may be fixed to the print medium M. As a result, the base image GA may be formed on the print medium M, as illustrated in FIG. 3.

[Primary Transfer Process (Second Time)]

Thereafter, in the transfer section 40, upon the transfer belt 41 moving in the moving direction F5, the color toners, i.e., the yellow toner, the magenta toner, the cyan toner, and the black toner, may undergo the primary transfer onto the transfer belt 41 from the respective photosensitive drums 32, i.e., from the respective electrostatic latent images, as the primary transfer rollers 45Y, 45M, 45C, and 45K are in contact with the respective photosensitive drums 32 with the transfer belt 41 interposed therebetween. Thereby, the color toner image ZB may be formed on the transfer belt 41.

[Secondary Transfer Process (Second Time)]

Thereafter, in the transfer section 40, upon the transfer belt 41 moving further in the moving direction F5, the color toner image ZB may undergo the secondary transfer onto the print medium M from the transfer belt 41, as illustrated in FIG. 4, as the secondary transfer roller 46 is in contact with the backup roller 44 with the transfer belt 41 interposed therebetween. In this case, the color toner image ZB may undergo the secondary transfer onto the print medium M in a region that overlaps a portion or a whole of a region where the base image GA has been formed, i.e., the region where the base toner image ZA has been transferred. In one example embodiment, the color toner image ZB may undergo the secondary transfer onto the print medium M within the region where the base image GA has been formed. Thereby, the base image GA that has already been formed on the print medium M may be overlaid with the color toner image ZB. The printing density of the color toner image ZB may be set as desired.

[Fixing Process (Second Time)]

Lastly, in the fixing section 50, the color toner image ZB may be heated by the heating roller 51 while having applied with pressure by the pressure-applying roller 52. Thereby, the color toner image ZB may be fixed to the print medium M. As a result, the color image GB may be formed on the print medium M, as illustrated in FIG. 5. In this case, the color image GB may be formed on the base image GA, and therefore, the print medium M may be overlaid with the base image GA and the color image GB in this order. Accordingly, the image G that includes the base image GA and the color image GB may be formed.

This may complete the operation of forming the image G. The print medium M on which the image G has been formed may be conveyed along the conveyance route R2 and discharged onto the stacker 2 through the discharge opening 1H.

[1-4. Example Workings and Example Effects]

In the image forming apparatus, the base toner image ZA and the color toner image ZB are transferred in this order onto the print medium M with the use of the base toner having the complex viscosity η (100° C.) within the above-described range, i.e., the complex viscosity η that falls within the range from 625 Pa·s to 3860 Pa·s, both inclusive, and the color toner. Accordingly, it is possible to form the image G with high quality for the reasons described below.

Figure 6:
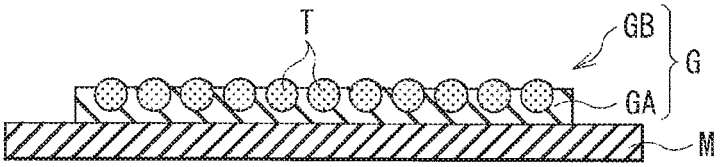
FIG. 6 is a cross-sectional view for describing an example advantage of an image formed with the use of the image forming apparatus according to one embodiment of the technology.
Figure 7:
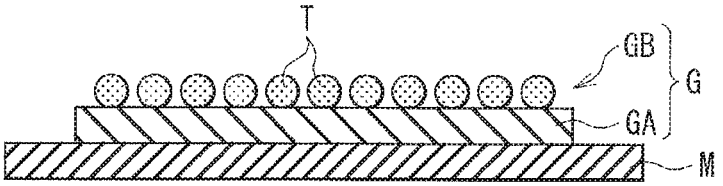
FIG. 7 is a cross-sectional view for describing a disadvantage of an image formed with the use of an image forming apparatus according to a second comparative example.

FIG. 6 illustrates a cross-sectional configuration, corresponding to FIG. 5, for describing an advantage of the image G formed with the use of the image forming apparatus according to the present example embodiment. FIG. 7 illustrates a cross-sectional configuration, corresponding to FIG. 5, for describing disadvantages of an image G formed with the use of an image forming apparatus according to a second comparative example. FIGS. 6 and 7 each illustrate the color image GB schematically or illustrate, more specifically, a plurality of color toners T included in the color image GB.

An image G formed with the use of an image forming apparatus according to a first comparative example has a configuration similar to that of the image G formed with the use of the image forming apparatus according to the present example embodiment except that the complex viscosity η (100° C.) of the base toner in the first comparative example is outside the above-described range since the complex viscosity η (100° C.) of the base toner in the first comparative example is smaller than 625 Pa·s.

The image G formed with the use of the image forming apparatus according to the second comparative example has a configuration similar to that of the image G formed with the use of the image forming apparatus according to the present example embodiment except that the complex viscosity η (100° C.) of the base toner in the second comparative example is outside the above-described range since the complex viscosity η (100° C.) of the base toner in the second comparative example is greater than 3860 Pa·s.

In a case where the image G of the first comparative example is formed, the heat durability of the base toner is reduced since the complex viscosity η (100° C.) of the base toner is excessively small. In this case, when friction occurs between the base toner and the developing blade, it is easier for the base toner to stick to the developing blade due to the friction. This makes it easier for so-called blade filming to occur. Accordingly, at a portion of the developing blade where the base toner has stuck, it is easier for a transfer defect of the color toner onto the print medium M to occur. This makes it easier for a concern such as a so-called vertical white streak to occur in the image G.

In a case where the image G of the second comparative example is formed, it is more difficult for the base image GA to soften during the fixing process, i.e., during heating, of the color toner image ZB, since the complex viscosity η (100° C.) of the base toner is excessively great. In this case, as illustrated in FIG. 7, because it is more difficult for the color toners T to get into the base image GA, it is more difficult for the color toners T to be embedded into the base image GA, making it more difficult to fix the color image GB to the base image GA. Further, it is more difficult for the base image GA to make close contact with the print medium M, making it more difficult to fix the base image GA to the print medium M. This makes it easier for the color image GB to peel off of the base image GA and makes it easier for the base image GA to peel off of the print medium M. Therefore, it is easier for the image G to peel off of the print medium M.

In contrast, in a case where the image G of the present example embodiment is formed, the complex viscosity η (100° C.) of the base toner may be appropriate. In this case, the heat durability of the base toner is ensured. It is therefore more difficult for the base toner to stick to the developing blade. Accordingly, it is more difficult for the blade filming to occur. As a result, it is more difficult for a concern such as a vertical white streak to occur in the image G.

Further, since it is easier for the base image GA to soften, as illustrated in FIG. 6, it is easier for the color toners T to get into the base image GA. It is therefore easier for the color toners T to be embedded into the base image GA. It is therefore easier for the color image GB to be fixed to the base image GA through a so-called anchoring effect. Since it is easier for the base image GA to come into close contact with the print medium M, it is easier for the base image GA to be fixed to the print medium M. Accordingly, it is more difficult for the color image GB to peel off of the base image GA, and it is more difficult for the base image GA to peel off of the print medium M. As a result, it is more difficult for the image G to peel off of the print medium M.

On the basis of the above, it is more difficult for a concern such as a vertical white streak to occur in the image G, and it is more difficult for the image G to peel off of the print medium M. Accordingly, the fixing performance of the image G to the print medium M improves while the image quality of the image G is ensured, making it possible to form the image G with high quality.

In this case, the fixing performance of the image G to the print medium M improves, as described above. This makes it easier for the image G, including the base image GA and the color image GB, to be fixed to the print medium M also when the smoothness of the surface of the print medium M is high. Further, this makes it easier for the image G to be fixed to the print medium M also when the fixing temperature is not raised excessively high when forming the image G. Accordingly, also in a case where the print medium M that is a resin print medium having high surface smoothness is used, it is possible to obtain the above-described effect while preventing the print medium M from being deformed or damaged due to an excessively-high fixing temperature.

Aside from the above, in one example embodiment, the transfer section 40 may transfer the color toner image ZB onto the print medium M within the transfer region of the base toner image ZA. In this case, the base toner image ZA is present between the whole of the color toner image ZB and the print medium M. Accordingly, the fixing performance of the image G to the print medium M improves notably. Hence, it is possible to obtain a higher effect.

In one example embodiment, the two conditions described above concerning the weight X and the total weight Y may be satisfied. In this case, the fixing performance of the image G to the print medium M further improves while the density of the color image GB is ensured for the reasons described below. Hence, it is possible to obtain a higher effect.

Figure 8:
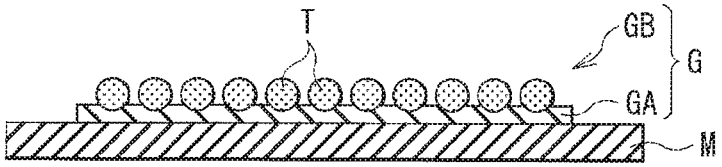
FIG. 8 is a cross-sectional view of a configuration of a print medium on which an image is formed with the use of an image forming apparatus according to a third comparative example.
Figure 9:
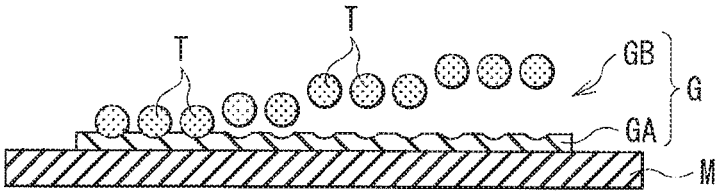
FIG. 9 is a cross-sectional view for describing a disadvantage of an image formed with the use of the image forming apparatus according to the third comparative example.

FIG. 8, corresponding to FIG. 5, illustrates a cross-sectional configuration of the print medium M on which an image G is formed with the use of an image forming apparatus according to a third comparative example. FIG. 9 illustrates a cross-sectional configuration, corresponding to FIG. 8, for describing a disadvantage of the image G formed with the use of the image forming apparatus according to the third comparative example.

Figure 10:
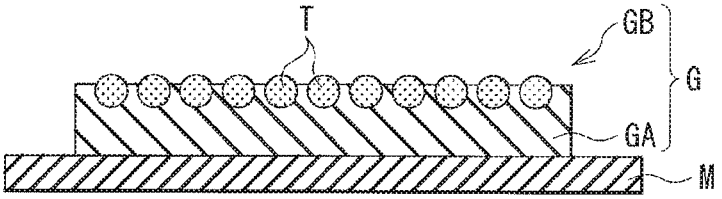
FIG. 10 is a cross-sectional view of a configuration of a print medium on which an image is formed with the use of an image forming apparatus according to a fourth comparative example.
Figure 11:
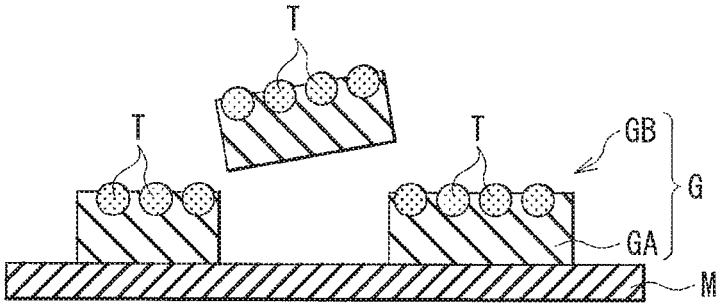
FIG. 11 is a cross-sectional view for describing a disadvantage of an image formed with the use of the image forming apparatus according to the fourth comparative example.

FIG. 10, corresponding to FIG. 5, illustrates a cross-sectional configuration of the print medium M on which an image G is formed with the use of an image forming apparatus according to a fourth comparative example. FIG. 11 illustrates a cross-sectional configuration, corresponding to FIG. 10, for describing a disadvantage of the image G formed with the use of the image forming apparatus according to the fourth comparative example.

As illustrated in FIG. 8, the image G formed with the use of the image forming apparatus according to the third comparative example has a configuration similar to that of the image G formed with the use of the image forming apparatus according to the present example embodiment except that the above-described two conditions concerning the weight X and the total weight Y are not satisfied since the weight X is smaller than 0.20 $mg/cm^2$.

As illustrated in FIG. 10, the image G formed with the use of the image forming apparatus according to the fourth comparative example has a configuration similar to that of the image G formed with the use of the image forming apparatus according to the present example embodiment except that the above-described two conditions concerning the weight X and the total weight Y are not satisfied since the weight X is greater than 0.40 $mg/cm^2$.

In a case where the image G of the third comparative example is formed, as illustrated in FIG. 8, the formation amount of the base image GA is excessively small as the weight X is excessively small. For this reason, there is a possibility that it is more difficult for the color toners T to be embedded into the base image GA. Therefore, a sufficient anchoring effect is not obtained, and there is a possibility that it is easier for rubbing of the image G to cause the color image GB, i.e., the color toners T, to peel off of the base image GA, as illustrated in FIG. 9. Further, the formation amount of the color image GB is excessively small as the total weight Y is excessively small. For this reason, there is also a possibility that the absolute amount of the color toners T is insufficient. Accordingly, there is a possibility that the density of the image G, i.e., the color image GB, is insufficient.

In a case where the image G of the fourth comparative example is formed, as illustrated in FIG. 10, the formation amount of the base image GA is excessively great as the weight X is excessively great. Accordingly, there is a possibility that it is more difficult for the base image GA to soften. This makes it more difficult to fix the base image GA to the print medium M. For this reason, as illustrated in FIG. 11, there is a possibility that it is easier for rubbing of the image G cause the base image GA to peel off of the print medium M. In this case, for example, there may be a possibility that it is easier for rubbing of the image G to cause a portion of the base image GA to peel off of the print medium M together with a portion of the color image GB.

In contrast, in a case where the image G of the present example embodiment is formed, the weight X may be made appropriate, and the total weight Y may be made appropriate accordingly. In this case, the amount of the color toners T may be ensured, and therefore, the image G, i.e., the color image GB, has a sufficiently-high density. Further, it is easier for the color toners T to be embedded into the base image GA, and it is easier for the base image GA to make close contact with the print medium M. For this reason, even if the image G is rubbed, it is more difficult for the image G, including the base image GA and the color image GB, to peel off of the print medium M. Accordingly, the fixing performance of the image G to the print medium M further improves while the density of the color image GB is ensured.

In one example embodiment, the above-described weight X may be the weight, per unit area, of the base toner image ZA in the region in which the transfer region of the base toner image ZA and the transfer region of the color toner image ZB overlap each other and the above-described total weight Y may be the sum of the weight X of the base toner image ZA per unit area and the weight of the color toner image ZB per unit area in the region in which the transfer region of the base toner image ZA and the transfer region of the color toner image ZB overlap each other. In addition thereto, the base toner image ZA may be present between the whole of the color toner image ZB and the print medium M. In this case, the weight X and the total weight Y are each made appropriate. Accordingly, the fixing performance of the image G to the print medium M notably improves. Hence, it is possible to obtain a higher effect.

In one example embodiment, the Bekk smoothness of the surface of the print medium M may be no lower than 100000 seconds. In this case, it is easier for the image G to be fixed to the print medium M also when the smoothness of the surface of the print medium M is high. Hence, it is possible to obtain a higher effect.

In one example embodiment, the image forming apparatus may include the fixing section 50, and the fixing section 50 may fix the base toner image ZA to the print medium M and thereafter fix the color toner image ZB to the print medium M. In this case, the base image GA is formed, and thereafter, the color image GB is formed on that base image GA. This makes it easier for the base image GA to be fixed to the print medium M and also makes it easier for the color image GB to be fixed to the base image GA. Accordingly, it is more difficult for the image G to peel off of the print medium M. Hence, it is possible to obtain a higher effect.

In one example embodiment, the weight-average molecular weight Mw of the binder resin included in the base toner may fall within the range from 5242 to 18039, both inclusive. In this case, the image quality of the image G improves sufficiently, and the fixing performance of the image G to the print medium M also improves sufficiently. Hence, it is possible to obtain a higher effect.

In one example embodiment, the base toner may be a clear toner. In this case, the hue of the base toner image ZA has little influence on the hue of the color toner image ZB. Accordingly, the image quality of the image G improves. Hence, it is possible to obtain a higher effect.

In one example embodiment, the print medium M, i.e., the polymer compound, may include polyethylene terephthalate, polyvinyl chloride, or both. In this case, the material of the print medium M, i.e., the type of the polymer compound, is made appropriate in relation to the configuration and the physical property of the base toner described above. Accordingly, the fixing performance of the image G to the print medium M further improves. Hence, it is possible to obtain a higher effect.

In the image forming method implemented through the operation of the image forming apparatus described above, the base toner image ZA may be formed with the use of the base toner described above, the color toner image ZB may be formed with the use of the color toner, and thereafter the base toner image ZA and the color toner image ZB may be transferred in this order onto the print medium M. Accordingly, it is possible to form the image G with high quality for the reasons similar to those described above related to the image forming apparatus. Other example workings and other example effects of the image forming method may be similar to other example workings and other example effects of the image forming apparatus.

2. MODIFICATION EXAMPLES

For example, the configuration and the operation of the image forming apparatus described above may be changed as appropriate. For example, four types of color toners, i.e., the yellow toner, the magenta toner, the cyan toner, and the black toner, may be used above, however, there is no particular limitation on the types of the color toners. In a specific but non-limiting example, three types of color toners, e.g., the yellow toner, the magenta toner, and the cyan toner, may be used. In this case as well, the use of the base image GA makes it possible to obtain the advantages described above, making it possible to obtain similar effects.

Working Examples

Working examples of one example embodiment of the technology are described below in detail. The description is given in the following order.

1. Verification of Complex Viscosity η (100° C.) (Fixing Temperature=150° C.)
2. Verification of Weight X and Total Weight Y (Fixing Temperature=140° C.)
3. Conclusion

[1. Verification of Complex Viscosity η (100° C.) (Fixing Temperature=150° C.)]

First, verification of the complex viscosity η (100° C.) was conducted. In this case, the fixing temperature held when the image G, including the base image GA and the color image GB, was formed was set to 150° C.

Experiment Examples 1-1 to 1-8

Through the following procedures, the image G was formed on the print medium M with the use of the image forming apparatus, and the quality of the image G was evaluated.

[Preparation for Forming Image]

First, the image forming apparatus, the print medium M, and the toners were prepared.

[Image Forming Apparatus and Print Medium]

As the image forming apparatus, an electrophotographic full-color printer (five-color printer VINCI C941 available from Oki Data Corporation, located in Tokyo, Japan) was used. As the print medium M, a PET card (star white card NTCARD50 available from Sakurai Co., Ltd., located in Tokyo, Japan, having a Bekk smoothness of 205000) was used.

[Composition of Toner]

As the toners, one type of base toner, i.e., the clear toner, and four types of color toners, i.e., the yellow toner, the magenta toner, the cyan toner, and the black toner, were used.

[Composition of Color Toners]

The yellow toner included 5 parts by mass of a yellow colorant (Pigment Yellow 74), 100 parts by mass of a binder resin (amorphous polyester), 4 parts by mass of a release agent (paraffin wax SP-0145 available from Nippon Seiro Co., Ltd., located in Tokyo, Japan, having a melting point of 62° C.), 1 part by mass of an electric charge control agent (BONTRON P-51 available from Orient Chemical Industries Co., Ltd., located in Osaka, Japan), and 4.5 parts by mass of an external additive (complex oxide particle, colloidal silica, and silica powder) with respect to 100 parts by mass of a toner base particle.

The external additive included 1 part by mass of a complex oxide particle (STX801 available from Nippon Aerosil Co., Ltd., located in Tokyo, Japan, having a mean primary particle size of 18 nm) with respect to 100 parts by mass of the toner base particle, 1 part by mass of colloidal silica (sol-gel silica X-24-9163A available from Shin-Etsu Chemical Co., Ltd., located in Tokyo, Japan, having a mean primary particle size of 100 nm) with respect to 100 parts by mass of the toner base particle, 1 part by mass of silica powder (VPRY40S available from Nippon Aerosil Co., Ltd., located in Tokyo, Japan, having a mean primary particle size of 80 nm) with respect to 100 parts by mass of the toner base particle, and 1.5 parts by mass of silica powder (RY50 available from Nippon Aerosil Co., Ltd., located in Tokyo, Japan, having a mean primary particle size of 40 nm) with respect to 100 parts by mass of the toner base particle.

The magenta toner had a composition similar to that of the yellow toner except that the magenta toner included a magenta colorant (quinacridone) in place of the yellow colorant. The cyan toner had a composition similar to that of the yellow toner except that the cyan toner included a cyan colorant (Phthalocyanine Blue (C.I. Pigment Blue 15:3)) in place of the yellow colorant. The black toner had a composition similar to that of the yellow toner except that the black toner included a black colorant (carbon black) in place of the yellow colorant.

[Method of Manufacturing Base Toner]

Through the procedures described below, the base toner was manufactured by a solution suspension method.

First, a continuous phase was prepared. In this case, first, 1111 parts by mass of a suspension stabilizer (industrial sodium phosphate tri basic dodecahydrate) was mixed into 32678 parts by mass of an aqueous solvent (pure water), and this mixture was stirred at a temperature of 60° C. This stirring caused the suspension stabilizer to dissolve, and thereby, a first aqueous solution was obtained. Thereafter, dilute nitric acid for regulating pH was added to the first aqueous solution. Thereafter, 536 parts by mass of a suspension stabilizer (industrial calcium chloride anhydrate)

was mixed into 4357 parts by mass of an aqueous solvent (pure water), and the mixture was stirred. This stirring caused the suspension stabilizer to dissolve, and thereby, a second aqueous solution was obtained. Thereafter, the first aqueous solution and the second aqueous solution were mixed together, and this mixture was stirred with the use of a stirrer at a temperature of 60° C. The stirrer used was a line mill available from PRIMIX Corporation, located in Hyogo, Japan. The number of rotations in the stirring was 3566 rotations per minute, and the stirring time was 34 minutes. Thereby, the continuous phase was obtained.

Thereafter, a dispersed phase was prepared. In this case, first, an organic solvent (ethyl acetate at a temperature of 50° C.) was prepared. Thereafter, 143 parts by mass of a release agent (paraffine wax) and 3.72 parts by mass of a fluorescent brightener were mixed in this order into 7060 parts by mass of the organic solvent, and this mixture was stirred. Thereafter, 1760 parts by mass of a binder resin (crystalline polyester) was mixed to the above mixture, and the resulting mixture was stirred until a solid substance disappeared. Thereby, the dispersed phase was obtained. In this case, a crystalline polyester having any of series of weight-average molecular weights Mw described in Table 1 was used.

In this case, the molecular weight difference ΔMw relative to the weight-average molecular weight Mw (=108592) of the color toner was adjusted by using crystalline polyester having any of the series of weight-average molecular weights Mw, as described in Table 1.

Thereafter, granulation was performed with the use of the continuous phase and the dispersed phase, and thereby, the toner base particle was formed. In this case, after the continuous phase and the dispersed phase were mixed together, the mixture was stirred at a temperature of 55° C. with the use of the stirrer described above. The number of rotations in the stirring was 1000 rotations per minute, and the stirring time was 5 minutes. With this operation, the mixture was suspended and granulated, and thereby, a slurry solution including a plurality of granulated products was obtained. Thereafter, the slurry solution was distilled under reduced pressure, and thereby, the organic solvent (ethyl acetate) included in the slurry solution was volatilized and removed. Thereafter, a pH regulator (nitric acid) was added to the slurry solution to regulate pH to 1.5, and the slurry solution was filtered to dissolve and remove the suspension stabilizer. Thereafter, the plurality of granulated products included in the slurry solution was dehydrated, and the plurality of granulated products was redispersed in an aqueous solvent (pure water). Thereafter, the plurality of granulated products was washed with an aqueous solvent (pure water), and the plurality of granulated products was filtered. Thereafter, the plurality of granulated products was dehydrated and dried, and the plurality of granulated products was classified. Thereby, a plurality of toner base particles was obtained.

Lastly, 4.5 parts by mass of an external additive (complex oxide and silica powder) was mixed into 500 parts by mass of the toner base particle, and the mixture was stirred with the use of a stirrer. The stirrer used was a Henschel mixer available from Nippon Coke & Engineering Co., Ltd., located in Tokyo, Japan. The number of rotations in the stirring was 5400 rotations per minute, and the stirring time was 10 minutes. The external additive included 1 part by mass of complex oxide particles (STX801 available from Nippon Aerosil Co., Ltd., located in Tokyo, Japan, having a mean primary particle size of 18 nm) and 3.5 parts by mass of silica powder (VPRY40S available from Nippon Aerosil Co., Ltd., located in Tokyo, Japan, having a mean primary particle size of 80 nm). Thereby, the base toner was obtained.

In a case of manufacturing the base toner, the viscosity difference Δη (Pa·s) was adjusted relative to the complex viscosity η (100° C.)(=12605 Pa·s) of the color toner by varying the weight-average molecular weight Mw, as described in Table 1.

[Formation of Image]

Thereafter, the image G was formed on the print medium M with the use of the image forming apparatus to which the base toner and the color toners, i.e., the yellow toner, the magenta toner, the cyan toner, and the black toner, were mounted.

[Procedure and Condition for Forming Image]

Specifically, the image G, including the base image GA and the color image GB, was formed on the print medium M by performing the fixing process twice in accordance with the procedures illustrated in FIGS. 2 to 5 under an environmental condition where the temperature was 25° C. and the humidity was 55%. In other words, the base toner image ZA was transferred onto the print medium M, and thereafter, the base toner image ZA was fixed to the print medium M. Thereby, the base image GA was formed. Thereafter, the color toner image ZB was transferred onto the print medium M on which the base image GA had been formed, and thereafter, the color toner image ZB was fixed to the print medium M. Thereby, the color image GB was formed. This allowed the base image GA to be overlaid with the color image GB, and the image G was formed thereby. In this case, the fixing temperature was 150° C., the weight X was 0.2 $mg/cm^2$, and the total weight Y was 0.5 $mg/cm^2$.

[Image Pattern]

Figure 12:
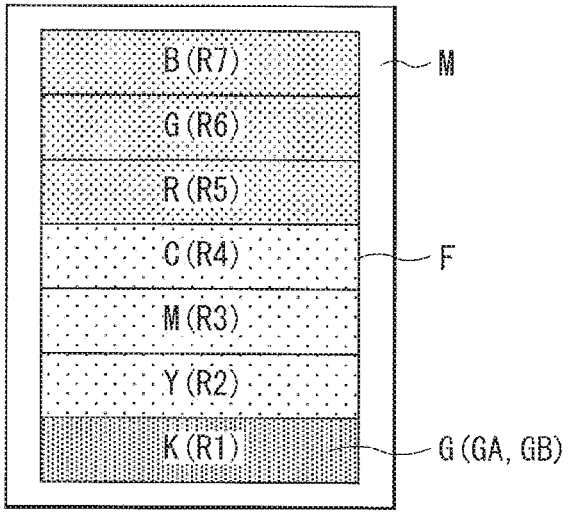
FIG. 12 is a plan view for describing an example of an image pattern having seven colors.

The base image GA and the color image GB each had an image pattern as described below. FIG. 12 illustrates a planar configuration of the print medium M on which the image G, including the base image GA and the color image GB, was formed, for describing an image pattern having seven colors.

As illustrated in FIG. 12, the print medium M included a rectangular image forming region F extending in the lengthwise direction. The image forming region F was a region in which it was possible to form the image G. The image forming region F was divided into seven regions in the lengthwise direction and thus included seven regions R1 to R7 arrayed in the lengthwise direction.

In a case where the base image GA was formed, a solid image was formed at a printing density of 100% in the image forming region F, that is, in all of the region covering from the region R1 to the region R7. In a case where the color image GB was formed with the use of the black toner, a solid image was formed at a printing density of 100% in the region R1. In a case where the color image GB was formed with the use of the yellow toner, a solid image was formed at a printing density of 100% in each of the regions R2, R5, and R6. In a case where the color image GB was formed with the use of the magenta toner, a solid image was formed at a printing density of 100% in each of the regions R3, R5, and R7. In a case where the color image GB was formed with the use of the cyan toner, a solid image was formed at a printing density of 100% in each of the regions R4, R6, and R7.

Thereby, the color image GB of black (K) was formed in the region R1, the color image GB of yellow (Y) was formed in the region R2, the color image GB of magenta (M) was formed in the region R3, and the color image GB of cyan (C) was formed in the region R4.

Further, the color image GB of red (R), i.e., a mixed color of yellow and magenta, was formed in the region R5; the color image GB of green (G), i.e., a mixed color of yellow and cyan, was formed in the ion R6; and the color image GB of blue (B), i.e., a mixed color of magenta and cyan, was formed in the region R7.

Thereby, the images G of seven colors, i.e., black, yellow, magenta, cyan, red, green, and blue, were formed on the print medium M.

[Evaluation of Quality of Image]

Thereafter, the quality of the image G was evaluated, and a result summarized in Table 1 was obtained. In this example, the fixing performance and the image quality were examined in order to evaluate the quality of the image G.

Figure 13:
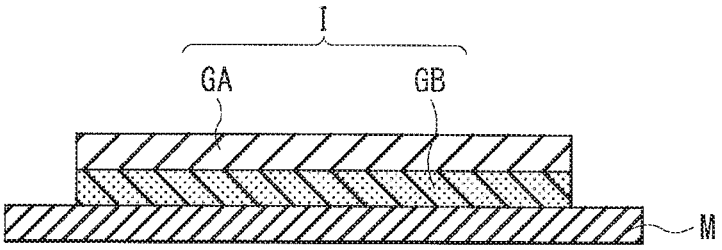
FIG. 13 is a cross-sectional view of a configuration of a print medium on which an image according to a comparative example is formed.

For comparison, an image I of a comparative example illustrated in FIG. 13 was also formed, and the quality of the image I was evaluated as well. The image I illustrated in FIG. 13 had a configuration similar to that of the image G except that the print medium M was overlaid with the color image GB and the base image GA in this order.

The column "Configuration" in Table 1 indicates the configuration of each image formed on the print medium M. Specifically, "M/GA/GB" indicates that the print medium M is overlaid with the base image GA and the color image GB in this order and the image G is thus formed on the print medium M. "M/GB/GA" indicates that the print medium M is overlaid with the color image GB and the base image GA in this order and the image I is thus formed on the print medium M.

The procedures for evaluating the image G are described below. The image I was also evaluated through similar procedures.

[Fixing Performance]

In a case where the fixing performance was examined, the whole of the image G formed on the print medium M was scratched with a fingernail five times, and the state of the image G was visually checked. Thereby, a level of a fixed state of the image G was determined. Specifically, the rating of level "5" was given in a case where none of the colors in the images G peeled off. The rating of level "4" was given in a case where only the image G of red peeled off. The rating of level "3" was given in a case where the image G of magenta and the images G of any two of red, green, and blue peeled off. The rating of level "2" was given in a case where the image G of magenta and all of the images G of red, green, and blue peeled off. The rating of level "1" was given in a case where the image(s) G in one or more of black, yellow, and cyan peeled off.

Thereafter, the levels of the fixed state of the images G described above were evaluated. Specifically, in a case where the fixed state of the image G was level 5, the image G did not peel off of the print medium M as the fixing performance of the image G to the print medium M was ensured. Therefore, this case was given an "A" rating. In a case where the fixed state of the image G was level 4, the image G hardly peeled off of the print medium M as the fixing performance of the image G to the print medium M improved sufficiently. Therefore, this case was given a "B" rating. In a case where the fixed state of the image G was level 3 or lower, the image G peeled off of the print medium M greatly as the fixing performance of the image G to the print medium M was not ensured. Therefore, this case was given a "C" rating.

[Image Quality]

In a case where the image quality was examined, the state of the image G formed on the print medium M was visually inspected to check whether a vertical white streak resulting from blade filming was present, and thereafter, the state of the image G was evaluated. Specifically, a case where no vertical white streak extending in the lengthwise direction of the print medium M was present was given an "A" rating. A case where the vertical white streak was present was given a "C" rating.

[Overall Evaluation]

After the fixing performance and the image quality described above were evaluated, the overall quality of the image G was evaluated on the basis of the above evaluation results. Specifically, a case where the evaluation result of the fixing performance yielded an A rating or a B rating and the evaluation result of the the image quality also yielded an A rating was given an "A" rating. A case where the evaluation result of the fixing performance, the evaluation result of the image quality, or both yielded a C rating was given a "C" rating.

TABLE 1

| Fixing temperature = 150° C. | | | | | | | | | | |
|---|---|---|---|---|---|---|---|---|---|---|
| | | Complex viscosity η | Viscosity difference | Weight-average molecular | Molecular weight | Fixing | | Image quality | | |
| Experiment | | (100° C.) | Δη | weight | difference | performance | | White | | Overall |
| example | Configuration | (Pa · s) | (Pa · s) | Mw | ΔMw | Level | Evaluation | streak | Evaluation | evaluation |
| 1-1 | M/GA/GB | 177 | 12428 | 3888 | 104704 | 1 | C | Occurred | C | C |
| 1-2 | M/GA/GB | 625 | 11980 | 5242 | 103350 | 5 | A | Not occurred | A | A |
| 1-3 | M/GA/GB | 1066 | 11539 | 12297 | 96295 | 5 | A | Not occurred | A | A |
| 1-4 | M/GA/GB | 1533 | 11072 | 13666 | 94926 | 5 | A | Not occurred | A | A |
| 1-5 | M/GA/GB | 2132 | 10473 | 12433 | 96159 | 5 | A | Not occurred | A | A |
| 1-6 | M/GA/GB | 3860 | 8745 | 18039 | 90553 | 4 | B | Not occurred | A | A |
| 1-7 | M/GA/GB | 25947 | −13342 | 22832 | 85760 | 1 | C | Not occurred | A | C |
| 1-8 | M/GB/GA | 1533 | 11072 | 13666 | 94926 | 1 | C | Occurred | C | C |

[Discussion]

As summarized in Table 1, the fixing performance and the image quality of each of the images G and I varied in accordance with the complex viscosity η (100° C.) of the base toner.

Specifically, in a case where the image I was used, that is, in a case where no base image GA was present between the print medium M and the color image GB (Experiment example 1-8), the advantage of using the base image GA described above was not obtained. Therefore, the fixing performance was insufficient, and the image quality decreased.

In contrast, in a case where the image G was used, that is, in a case where the base image GA was present between the print medium M and the color image GB (Experiment examples 1-1 to 1-7), the fixing performance and the image quality each exhibited different tendencies in accordance with the complex viscosity η (100° C.).

In a case where the complex viscosity η (100° C.) was smaller than 625 Pa·s (Experiment example 1-1), the fixing performance was insufficient and the image quality decreased. In a case where the complex viscosity η (100° C.) was greater than 3860 Pa·s (Experiment example 1-7), the image quality improved, but the fixing performance decreased. However, in a case where the complex viscosity η (100° C.) fell within a range from 625 Pa·s to 3860 Pa·s, both inclusive, (Experiment examples 1-2 to 1-6), the fixing performance was sufficient, and the image quality improved.

In particular, in the case where the complex viscosity η (100° C.) fell within the appropriate range, i.e., the range from 625 Pa·s to 3860 Pa·s, both inclusive, and on a condition that the complex viscosity η (100° C.) was within a range from 625 Pa·s to 2132 Pa·s, both inclusive, (Experiment examples 1-2 to 1-5), the fixing performance further improved.

In a case where the complex viscosity η (100° C.) fell within the appropriate range, and on a condition that the weight-average molecular weight Mw fell within a range from 5242 to 18039, both inclusive, both the fixing performance and the image quality were sufficient. Further, on a condition that the weight-average molecular weight Mw fell within a range from 5242 to 12433, both inclusive, the fixing performance further improved.

[2. Verification of Weight X and Total Weight Y (Fixing Temperature=140° C.)]

Thereafter, the verification of the weight X and the total weight Y was conducted. In this case, the fixing temperature held when the image G, including the base image GA and the color image GB, was formed was set to 140° C. In other words, a stricter verification condition was set by lowering the fixing temperature by 10° C. from the fixing temperature held in the case where the verification of the complex viscosity η (100° C.) was conducted as described above.

Experiment Examples 2-1 to 2-6

Through the following procedures, the image G was formed on the print medium M with the use of the image forming apparatus, and thereafter, the quality of the image G was evaluated. In this case, procedures similar to those in Experiment examples 1-1 to 1-8 described above were used except for the points described below.

[Formation of Image]

The image G was formed on the print medium M with the use of the image forming apparatus to which the base toner and the color toners, i.e., the yellow toner and the magenta toner, were mounted. In this case, the fixing temperature was 140° C. The weight X (mg/cm$^2$) and the total weight Y (mg/cm$^2$) were each adjusted, as summarized in Table 2, by varying the voltage applied to the developing roller, i.e., by varying the amount of the base toner and the amount of the color toner that were to be attached to the electrostatic latent image.

Figure 14:
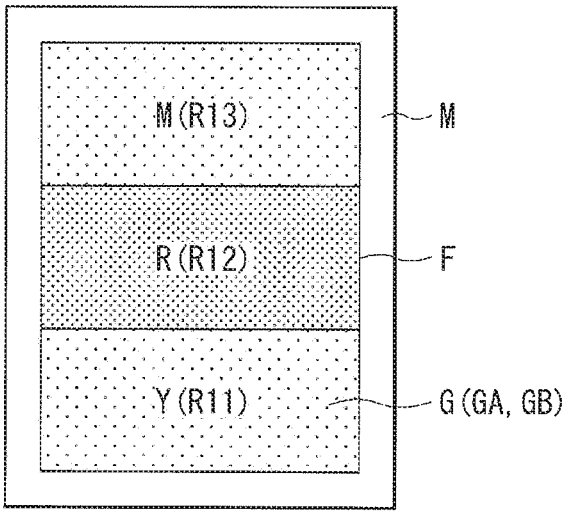
FIG. 14 is a plan view for describing an example of another image pattern having three colors.

The base image GA and the color image GB each had an image pattern as described below. FIG. 14, corresponding to FIG. 12, illustrates a planar configuration of the print medium M on which the image G, including the base image GA and the color image GB, was formed, for describing another image pattern having three colors.

An image forming region F set on the print medium M was divided into three and thus included three regions R11 to R13, as illustrated in FIG. 14. The region in which the base image GA was formed was the image forming region F, i.e., the regions R11 to R13, as described above. In a case where the color image GB was formed with the use of the yellow toner, a solid image was formed at a printing density of 100% in each of the regions R11 and R12. In a case where the color image GB was formed with the use of the magenta toner, a solid image was formed at a printing density of 100% in each of the regions R12 and R13. Thereby, the color image GB of yellow (Y) was formed in the region R11, the color image GB of red (R) was formed in the region R12, and the color image GB of magenta (M) was formed in the region R13.

Thereby, the images G of three colors, i.e., yellow, magenta, and red, were formed on the print medium M.

[Evaluation of Quality of Image]

Thereafter, the quality of the image G was evaluated, and the result summarized in Table 2 was obtained. Upon evaluating the quality of the image G, the fixing performance and a density characteristic were examined.

The procedures for determining the fixing performance and the procedures for evaluating the fixing performance were as described above. In a case where the density characteristic was examined, the density of the image G of yellow and the density of the image G of magenta were measured with the use of a spectrodensitometer (X-rite 518 available from X-Rite, Incorporated, located in Tokyo, Japan), and results of measuring these densities were evaluated. Specifically, in a case where the density was 1.2 or higher, a sufficient density was obtained. This case was therefore given an "A" rating. In a case where the density was lower than 1.2, a sufficient density was not obtained. This case was therefore given a "B" rating.

In Table 2, the result of evaluating the fixing performance (A or B) and the result of evaluating the density characteristic (A or B) are indicated side by side in a single cell. For example, the notation "B, B" indicates that the result of evaluating the fixing performance is B and the result of evaluating the density characteristic is B. The notation "A, A" indicates that the result of evaluating the fixing performance is A and the result of evaluating the density characteristic is A.

TABLE 2

| Fixing temperature = 140° C. | | | | | | | | | | | | | | | | | |
|---|---|---|---|---|---|---|---|---|---|---|---|---|---|---|---|---|---|
| Experiment | Weight X | Total weight Y ($mg/cm^2$) Fixing performance evaluation, Density characteristic evaluation | | | | | | | | | | | | | | | |
| example | ($mg/cm^2$) | 0.35 | 0.40 | 0.45 | 0.50 | 0.55 | 0.60 | 0.65 | 0.70 | 0.75 | 0.80 | 0.85 | 0.90 | 0.95 | 1.00 | 1.05 | |
| 2-1 | 0.1 | B, B | B, A | B, A | B, A | B, A | B, A | B, A | B, A | B, A | B, A | B, A | B, A | B, A | B, A | B, A | |
| 2-2 | 0.2 | B, B | B, B | B, B | A, A | A, A | A, A | A, A | B, A | B, A | B, A | B, A | B, A | B, A | B, A | B, A | |
| 2-3 | 0.3 | B, B | B, B | B, B | B, B | A, B | A, A | A, A | A, A | A, A | B, A | B, A | B, A | B, A | B, A | B, A | |
| 2-4 | 0.4 | B, B | B, B | B, B | B, B | B, B | B, B | A, B | A, A | A, A | A, A | A, A | B, A | B, A | B, A | B, A | |
| 2-5 | 0.5 | B, B | B, B | B, B | B, B | B, B | B, B | B, B | B, B | B, B | B, A | B, A | B, A | B, A | B, A | B, A | |
| 2-6 | 0.6 | B, B | B, B | B, B | B, B | B, B | B, B | B, B | B, B | B, B | B, B | B, B | B, A | B, A | B, A | B, A | |

[Discussion]

As summarized in Table 2, the fixing performance and the density characteristic of the image G varied in accordance with the weight X and the total weight Y.

Specifically, in a case where the weight X was smaller than 0.20 $mg/cm^2$ (Experiment example 2-1) and in a case where the weight X was greater than 0.40 $mg/cm^2$ (Experiment examples 2-5 and 2-6), the fixing performance was insufficient, and the density characteristic was also insufficient in some of the cases.

In contrast, in a case where the weight X was from 0.20 $mg/cm^2$ to 0.40 $mg/cm^2$, both inclusive (Experiment examples 2 to 2-4), the fixing performance was sufficient and the density characteristic was also sufficient depending on the relationship between the weight X and the total weight Y. In other words, in a case where the weight X was from 0.20 $mg/cm^2$ to 0.40 $mg/cm^2$, both inclusive, on a condition that the total weight Y was from (X+0.30) $mg/cm^2$ to (X+0.45) $mg/cm^2$, both inclusive, the relationship between the weight X and the total weight Y was appropriate. Therefore, both the fixing performance and the density characteristic were achieved.

[3. Conclusion]

On the basis of the results summarized in Tables 1 and 2, both the fixing performance and the image quality of the image G improved as the base toner having the complex viscosity η (100° C.) that fell within the specific range, i.e., the range from 625 Pa·s to 3860 Pa·s, both inclusive, and the color toner were used, and the base toner image ZA and the color toner image ZB were transferred in this order onto the print medium M. Hence, the image G with high quality was formed.

Thus far, one embodiment of the technology has been described above with reference to some example embodiments. Any embodiment of the technology, however, is not limited to the example embodiments described above.

In a specific but non-limiting example, the image forming apparatus according to any example embodiment of the technology is not limited to a printer, for example, and may be another apparatus such as a copier, a facsimile, or a multifunction peripheral. For example, the image forming method of the image forming apparatus according to any example embodiment of the technology is not limited to an intermediate transfer method in which an intermediate transfer medium is used, and the image forming apparatus may employ a direct transfer method in which no intermediate transfer medium is used.

Furthermore, the technology encompasses any possible combination of some or all of the various embodiments and the modifications described herein and incorporated herein.

It is possible to achieve at least the following configurations from the above-described example embodiments of the technology.

[1]

An image forming apparatus including:

a first toner image forming unit that forms a first toner image with use of a first toner, the first toner having a complex viscosity that falls within a range from 625 Pascal-seconds to 3860 Pascal-seconds, both inclusive, at a temperature of 100 degrees centigrade;

a second toner image forming unit that forms a second toner image with use of a second toner; and a transfer section that transfers the first toner image onto a print medium, and transfers the second toner image onto the print medium in a region that overlaps a portion or all of a region where the first toner image has been transferred, the print medium including a polymer compound.

[2]

The image forming apparatus according to [1], in which the transfer section transfers the second toner image onto the print medium within the region where the first toner image has been transferred.

[3]

The image forming apparatus according to [1] or [2], in which a first weight, per unit area, of the first toner image transferred onto the print medium falls within a range from 0.20 milligrams per square centimeter to 0.40 milligrams per square centimeter, both inclusive, and a sum of the first weight and a second weight, per unit area, of the second toner image transferred onto the print medium falls within a range from (X+0.30) milligrams per square centimeter to (X+0.45) milligrams per square centimeter, both inclusive, where X is the first weight.

[4]

The image forming apparatus according to [3], in which the first weight includes a weight of the first toner image per unit area in an overlapped region in which the region where the first toner image has been transferred and a region where the second toner image has been transferred overlap each other, and the sum includes a sum of the first weight of the first toner image per unit area in the overlapped region and a weight of the second toner image per unit area in the overlapped region.

[5]

The image forming apparatus according to any one of [1] to [4], in which the print medium includes a surface having a Bekk smoothness of no lower than 100000 seconds, the surface being a surface onto which each of the first toner image and the second toner image is to be transferred.

[6]

The image forming apparatus according to any one of [1] to [5], further including a fixing section that fixes, to the print medium, the first toner image transferred onto the print medium, and after fixing the first toner image to the print medium, fixes, to the print medium, the second toner image transferred onto the print medium.

[7]

The image forming apparatus according to any one of [1] to [6], in which the first toner includes a binder resin, the binder resin having a weight-average molecular weight that falls within a range from 5242 to 18039, both inclusive.

[8]

The image forming apparatus according to any one of [1] to [7], in which the first toner includes a clear toner.

[9]

The image forming apparatus according to any one of [1] to [8], in which the polymer compound includes polyethylene terephthalate, polyvinyl chloride, or both.

[10]

An image forming method including:

forming a first toner image with use of a first toner, the first toner having a complex viscosity that falls within a range from 625 Pascal-seconds to 3860 Pascal-seconds, both inclusive, at a temperature of 100 degrees centigrade;

forming a second toner image with use of a second toner;

transferring the first toner image onto a print medium, the print medium including a polymer compound; and transferring, after the transferring of the first toner image onto the print medium, the second toner image onto the print medium in a region that overlaps a portion or all of a region where the first toner image has been transferred.

[11]

The image forming method according to [10], in which the second toner image is transferred onto the print medium within the region where the first toner image has been transferred.

[12]

The image forming method according to [10] or [11], in which a first weight, per unit area, of the first toner image transferred onto the print medium falls within a range from 0.20 milligrams per square centimeter to 0.40 milligrams per square centimeter, both inclusive, and a sum of the first weight and a second weight, per unit area, of the second toner image transferred onto the print medium falls within a range from (X+0.30) milligrams per square centimeter to (X+0.45) milligrams per square centimeter, both inclusive, where X is the first weight.

[13]

The image forming method according to [12], in which the first weight includes a weight of the first toner image per unit area in an overlapped region in which the region where the first toner image has been transferred and a region where the second toner image has been transferred overlap each other, and the sum includes a sum of the first weight of the first toner image per unit area in the overlapped region and a weight of the second toner image per unit area in the overlapped region.

[14]

The image forming method according to any one of [10] to [13], in which a surface, of the print medium, onto which each of the first toner image and the second toner image is to be transferred has a Bekk smoothness of no lower than 100000 seconds.

[15]

The image forming method according to any one of [10] to [14], further including:

fixing, to the print medium, the first toner image transferred onto the print medium; and fixing, to the print medium, after the fixing of the first toner image to the print medium, the second toner image transferred onto the print medium.

[16]

The image forming method according to any one of [10] to [15], in which the polymer compound includes polyethylene terephthalate, polyvinyl chloride, or both.

The aforementioned "complex viscosity at a temperature of 100 degrees centigrade" may be obtained by analyzing the first toner with the use of a viscoelasticity measuring apparatus. In this case, for example, Discovery HR-2 available from TA Instruments, located in Delaware, United States, may be used as the viscoelasticity measuring apparatus. As for the analysis conditions: a measured temperature range may be from 50° C. to 230° C., both inclusive; a temperature increase rate may be 5° C./min; and a frequency may be 1 Hz.

According to any of the image forming apparatus and the image forming method of one embodiment of the technology, the first toner having the complex viscosity at the temperature of 100 degrees centigrade within the above-described range and the second toner were used, and the first toner image and the second toner image are transferred in this order onto the print medium. Hence, it is possible to form a high-quality image.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

a first toner image forming unit that forms a first toner image with use of a first toner, the first toner having a complex viscosity that falls within a range from 625 Pascal-seconds to 3860 Pascal-seconds, both inclusive, at a temperature of 100 degrees centigrade;

a second toner image forming unit that forms a second toner image with use of a second toner; and a transfer section that transfers the first toner image onto a print medium, and transfers the second toner image onto the print medium in a region that overlaps a portion or all of a region where the first toner image has been transferred, the print medium including a polymer compound, wherein the print medium includes a surface having a Bekk smoothness of no lower than 100000 seconds, the surface being a surface onto which each of the first toner image and the second toner image is to be transferred.

2. An image forming apparatus comprising:

a first toner image forming unit that forms a first toner image with use of a first toner, the first toner having a complex viscosity that falls within a range from 625 Pascal-seconds to 3860 Pascal-seconds, both inclusive, at a temperature of 100 degrees centigrade;

a second toner image forming unit that forms a second toner image with use of a second toner; and a transfer section that transfers the first toner image onto a print medium, and transfers the second toner image onto the print medium so that the second toner image partially or entirely overlaps the first toner image on the print medium, wherein the complex viscosity of the first toner at the temperature of 100 degrees centigrade is less than a complex viscosity of the second toner at the temperature of 100 degrees centigrade, and wherein a difference between the complex viscosity of the first toner at the temperature of 100 degrees centigrade and the complex viscosity of the second toner at the temperature of 100 degrees centigrade falls within a range from 8745 Pascal-seconds to 11980 Pascal-seconds, both inclusive.

3. The image forming apparatus according to claim 2, wherein the transfer section transfers the second toner image onto the print medium within the region where the first toner image has been transferred.

4. The image forming apparatus according to claim 2, wherein a first weight, per unit area, of the first toner image transferred onto the print medium falls within a range from 0.20 milligrams per square centimeter to 0.40 milligrams per square centimeter, both inclusive, and a sum of the first weight and a second weight, per unit area, of the second toner image transferred onto the print medium falls within a range from (X+0.30) milligrams per square centimeter to (X+0.45) milligrams per square centimeter, both inclusive, where X is the first weight.

5. The image forming apparatus according to claim 4, wherein the first weight comprises a weight of the first toner image per unit area in an overlapped region in which the region where the first toner image has been transferred and a region where the second toner image has been transferred overlap each other, and the sum comprises a sum of the first weight of the first toner image per unit area in the overlapped region and a weight of the second toner image per unit area in the overlapped region.

6. The image forming apparatus according to claim 2, further comprising a fixing section that fixes, to the print medium, the first toner image transferred onto the medium and fixes, to the print medium, the second toner image transferred onto the print medium.

7. The image forming apparatus according to claim 6, further comprising a conveying member configured to convey the print medium:

(a) to the transfer section for the transfer section to transfer the first toner image onto the print medium, (b) from the transfer section to the fixing section for the fixing section to fix the first toner image transferred onto the print medium, (c) from the fixing section to the transfer section for the transfer section to transfer the second toner image onto the print medium, and (d) from the transfer section to the fixing section for the fixing section to fix the second toner image transferred onto the print medium.

8. The image forming apparatus according to claim 2, wherein the first toner includes a binder resin, the binder resin having a weight-average molecular weight that falls within a range from 5242 to 18039, both inclusive.

9. The image forming apparatus according to claim 2, wherein the first toner comprises a clear toner.

10. The image forming apparatus according to claim 2, wherein the print medium includes a polymer compound.

11. The image forming apparatus according to claim 10, wherein the polymer compound includes polyethylene terephthalate, polyvinyl chloride, or both.

12. The image forming apparatus according to claim 2, further comprising a conveying member configured to:

(a) convey the print medium to the transfer section for the transfer section to transfer the first toner image onto the print medium, and (b) recirculate the print medium to the transfer section for the transfer section to transfer the second toner image onto the print medium.

13. An image forming apparatus comprising:

a first toner image forming unit that forms a first toner image with use of a first toner, the first toner having a complex viscosity that falls within a range from 625 Pascal-seconds to 3860 Pascal-seconds, both inclusive, at a temperature of 100 degrees centigrade;

a second toner image forming unit that forms a second toner image with use of a second toner; and a transfer section that transfers the first toner image onto a print medium, and transfers the second toner image onto the print medium so that the second toner image partially or entirely overlaps the first toner image on the print medium, wherein the complex viscosity of the first toner at the temperature of 100 degrees centigrade is less than a complex viscosity of the second toner at the temperature of 100 degrees centigrade, and wherein the first toner includes a binder resin, the binder resin having a weight-average molecular weight that falls within a range from 5242 to 18039, both inclusive.

* * * * *